US009336710B2

(12) United States Patent
Ryu et al.

(10) Patent No.: US 9,336,710 B2
(45) Date of Patent: May 10, 2016

(54) ORGANIC LIGHT EMITTING DISPLAY AND METHOD OF DRIVING THE SAME

(75) Inventors: Do-Hyung Ryu, Suwon-si (KR); Do-Ik Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1673 days.

(21) Appl. No.: 12/328,691

(22) Filed: Dec. 4, 2008

(65) Prior Publication Data

US 2009/0146978 A1 Jun. 11, 2009

(30) Foreign Application Priority Data

Dec. 6, 2007 (KR) ..... 10-2007-0126214

(51) Int. Cl.
*G09G 5/00* (2006.01)
*G09G 3/32* (2016.01)

(52) U.S. Cl.
CPC ..... *G09G 3/3233* (2013.01); *G09G 2310/0213* (2013.01); *G09G 2320/0233* (2013.01); *G09G 2360/18* (2013.01)

(58) Field of Classification Search
USPC ..... 345/213, 530, 204; 348/567, 500, 513
See application file for complete search history.

(56) References Cited

U.S. PATENT DOCUMENTS

| | | | | |
|---|---|---|---|---|
| 6,320,572 | B1 * | 11/2001 | Takabayashi et al. | 345/204 |
| 2003/0063077 | A1 * | 4/2003 | Koyama | 345/204 |
| 2004/0233190 | A1 * | 11/2004 | Chow | H03K 19/018585 345/204 |
| 2006/0092100 | A1 * | 5/2006 | Chou | G09G 5/005 345/55 |
| 2008/0001875 | A1 * | 1/2008 | Yuuki et al. | 345/87 |

FOREIGN PATENT DOCUMENTS

| | | |
|---|---|---|
| JP | 2001-160290 | 6/2001 |
| JP | 2004-171522 | 6/2004 |
| KR | 10-2001-0061433 | 7/2001 |
| KR | 2001-0097832 A | 11/2001 |
| KR | 10-0490944 | 5/2005 |
| KR | 10-2006-0000929 | 1/2006 |
| KR | 10-2007-0071158 | 7/2007 |

OTHER PUBLICATIONS

Korean Office action dated Feb. 24, 2009 in the corresponding Korean application No. 9-5-2009-008274747.

Patent Abstracts of Japan, Publication 2004-171522, Published Jun. 17, 2004, for Engelhardt.

Korean Patent Abstracts, Publication 100490944 B1, Published May 13, 2005, for Park.

Korean Patent Abstracts, Publication 1020070071158 A, Published Apr. 17, 2007, for Kim, et al.

Korean Office action dated Apr. 29, 2009, for priority Korean application 10-2007-0126214, noting listed references in this IDS, as well as KR 10-2001-0097832, previously filed an IDS dated Apr. 2, 2009.

* cited by examiner

*Primary Examiner* — Christopher E Leiby
(74) *Attorney, Agent, or Firm* — Lewis Roca Rothgerber Christie LLP

(57) ABSTRACT

An organic light emitting display capable of preventing data collision to improve picture quality. The organic light emitting display includes pixels positioned at crossings between scan lines and data lines, a scan driver for driving the scan lines, a data driver for driving the data lines, a timing controller for controlling the scan driver and the data driver, and an input controller for receiving data and an input clock, and for controlling a point in time where the data is supplied to the timing controller in response to at least one clock signal supplied from the timing controller.

15 Claims, 5 Drawing Sheets

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2007-0126214, filed on Dec. 6, 2007, in the Korean Intellectual Property Office, the entire content of which is incorporated herein by reference.

BACKGROUND

1. Field of the Invention

The present invention relates to an organic light emitting display and a method of driving the same.

2. Discussion of the Related Art

Recently, various flat panel displays (FPDs) having reduced weight and volume in comparison to cathode ray tubes (CRTs) have been developed. The FPDs include liquid crystal displays (LCDs), field emission displays (FEDs), plasma display panels (PDPs), and organic light emitting displays.

Among the FPDs, the organic light emitting displays display images using organic light emitting diodes (OLEDs) that generate light by re-combination of electrons and holes. The organic light emitting display has high response speed and is driven with low power consumption.

In general, the pixels of the organic light emitting display charge a predetermined voltage in a storage capacitor Cst included in each of the pixels and supply current corresponding to the charged voltage to the OLEDs to display an image (analog driving). However, in the above described method, it is difficult to display a uniform image due to variations of the threshold voltage and mobility of a driving transistor included in each of the pixels.

In order to solve the above problem, a digital driving method is provided. In the digital driving method, one frame is divided into a plurality of sub frames and the emission and non-emission of the pixels are controlled in each sub frame to display an image. For example, an emission period included in each of the plurality of sub frame periods included in one frame is increased in the ratio of $2^n$ (n=0, 1, 2, 3, 4, 5, 6, and 7). In this case, the emission of the pixels is controlled in the emission period of each of the sub frames to display an image of predetermined gray levels.

In the digital driving method, the driving transistor included in each of the pixels is turned on or off to display gray levels. When the gray levels are realized using the turning on or off of the driving transistor, an image with uniform brightness can be displayed regardless of non-uniformity of the driving transistor.

In the digital driving method, since data are supplied to a data driver in units of sub frames, data are stored and output using a dual port memory. In more detail, the dual port memory stores data in response to a first clock from the outside and outputs the stored data in response to a second clock having a different frequency from the frequency of the first clock.

However, since one cell includes eight transistors in the dual port memory, cost and mounting area increase when an integrated circuit is realized. In order to solve the problem, a method of driving a conventional memory (a pseudo dual port memory (including six transistors in one cell)) together with the dual port memory is used. That is, data are stored and output while a first clock and a second clock are supplied to a memory.

However, when the conventional memory is used together with the dual port memory, collision (for example, read and write clocks can be supplied to the same cell) can be generated in reading and writing operations. In order to prevent such a phenomenon, a phase locked loop (PLL) is used. However, the circuit structure of the PLL is complicated and a large mounting area is occupied.

SUMMARY OF THE INVENTION

Accordingly, it is an aspect of the present invention to provide an organic light emitting display capable of preventing the collision of a memory to improve picture quality and a method of driving the same.

In order to achieve the foregoing and/or other aspects of the present invention, according to an aspect of a first exemplary embodiment of the present invention, there is provided an organic light emitting display, including pixels positioned at crossings between scan lines and data lines, a scan driver for driving the scan lines, a data driver for driving the data lines, a timing controller for controlling the scan driver and the data driver, and an input controller for receiving data and an input clock, and for controlling a point in time where the data is supplied to the timing controller in response to at least one clock signal supplied from the timing controller.

The input controller may include a first storage unit for outputting first output data in response to the input clock, at least one second storage unit for outputting second output data utilizing the first output data supplied from the first storage unit in response to the at least one clock signal, and an outputting unit for comparing the second output data of the at least one second storage unit with the first output data of the first storage unit to supply the data to the timing controller when the second output data of the second storage unit is the same as the first output data of the first storage unit.

According to an aspect of a second exemplary embodiment of the present invention, there is provided a method of driving an organic light emitting display including a plurality of pixels, the method including supplying data from an external system, controlling a point in time where the data is stored in a frame memory utilizing at least one clock signal supplied by a timing controller, supplying data stored in the frame memory to a data driver to convert the data to a data signal, and controlling light emission of the plurality of pixels emit light in accordance with the data signals.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
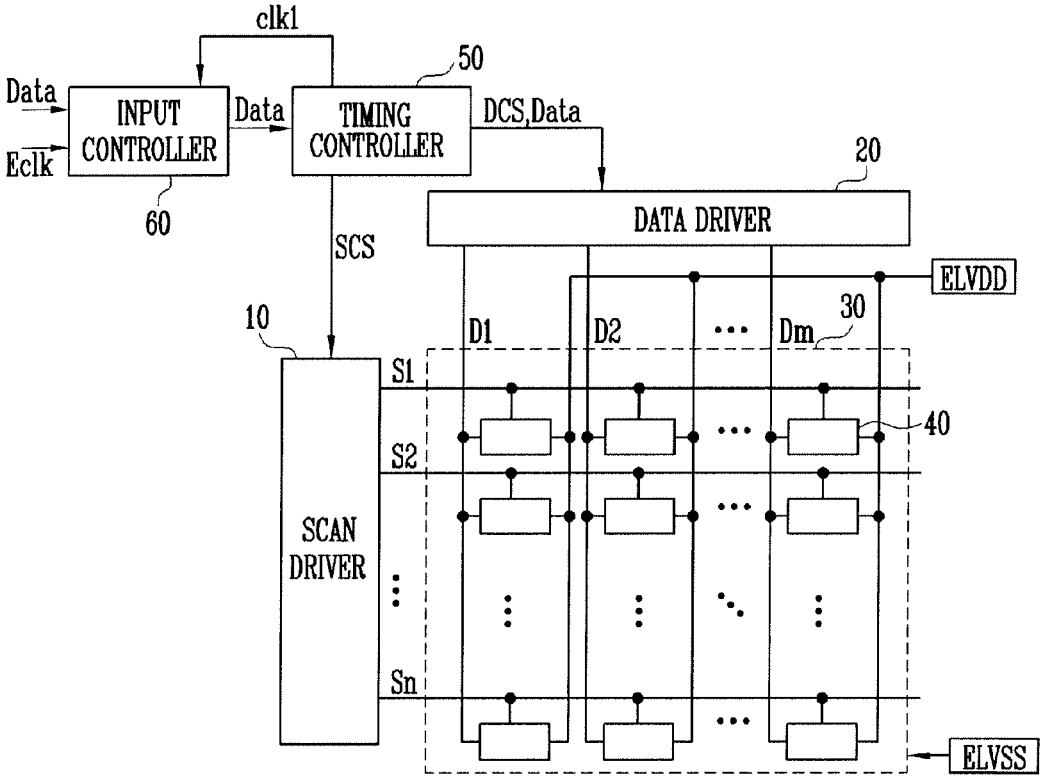
FIG. 1 illustrates an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element, or alternatively, may be indirectly coupled to the second element via a third element. Further, some of the elements that are not essential to the complete understanding of the invention are omitted for clarity. Also, like reference numerals refer to like elements throughout.

FIG. 1 illustrates an organic light emitting display according to an embodiment of the present invention. By way of example, the organic light emitting display shown in FIG. 1 may be driven using a digital driving method.

Referring to FIG. 1, the organic light emitting display according to an embodiment of the present invention includes a display region 30 including pixels 40 coupled to scan lines S1 to Sn and data lines D1 to Dm, a scan driver 10 for driving the scan lines S1 to Sn, a data driver 20 for driving the data lines D1 to Dm, a timing controller 50 for controlling the scan driver 10 and the data driver 20, and an input controller 60 for controlling the input point of time of data Data (i.e., the point in time at which data Data is input).

The timing controller 50 generates data driving control signals DCS and scan driving control signals SCS in response to synchronization signals supplied from the outside (i.e., external synchronization signals). The data driving control signals DCS generated by the timing controller 50 are supplied to the data driver 20 and the scan driving control signals SCS are supplied to the scan driver 10. In addition, the timing controller 50 receives the data Data from the input controller 60 to supply the received data Data to the data driver 20. Therefore, the timing controller 50 includes a frame memory (not shown).

The input controller 60 receives the data Data and an external clock Eclk (or input clock) from the outside (e.g., received through a signal receiver in the organic light emitting display). The input controller 60 also receives at least one clock signal CLK1 from the timing controller 50. The clock signal CLK1 may be generated by the timing controller 50, but the present invention is not limited thereto. In FIG. 1, one clock signal CLK1 is supplied to the input controller 60. However, the present invention is not limited to the above. The input controller 60 is controlled by the clock signal CLK1 to supply the data Data supplied from the outside to the timing controller 50.

The scan driver 10 sequentially supplies scan signals to the scan lines S1 to Sn in each sub frame. Then, the pixels 40 are sequentially selected in units of lines. In other words, the pixels 40 are sequentially scanned line by line to be selected.

The data driver 20 supplies data signals to the data lines D1 to Dm in synchronization with the scan signals. Hence, the data signals are supplied to the pixels 40 selected by the scan signals. Here, the data signals are divided into first signals in response to which the pixels 40 emit light and second data signals in response to which the pixels 40 do not emit light.

The display region 30 receives a first power source ELVDD and a second power source ELVSS from the outside to supply the first power source ELVDD and the second power source ELVSS to the pixels 40. The pixels 40 receive the first signal signals or the second data signals when the scan signals are supplied and emit light or do not emit light in each sub frame in response to the received data signals.

The above-described organic light emitting display according to an exemplary embodiment of the present invention can control the supply point of time of the data Data supplied (i.e., the point in time at which the data Data is supplied) from the timing controller 50 using the input controller 60. Alternatively, when the input controller 60 does not exist, the data Data supplied from the outside and the external clock Eclk are directly supplied to the frame memory included in the timing controller 50. In this case, since the input point of time of the data Data (i.e., the point in time at which the data Data is input) is determined by the external clock Eclk (that is, used as a writing clock), that is, since the input point of time of the data Data cannot be controlled by the organic light emitting display, collision can be generated by the memory between the read clock and the write clock.

However, according to an exemplary embodiment of the present invention, since the input point of time of the data Data is determined by the clock signal CLK1 supplied from the timing controller 50, it is possible to prevent collision from being generated by the memory. That is, since the input point of time of the data Data is controlled by the organic light emitting display according to an exemplary embodiment of the present invention, it is possible to prevent collision from being generated between the read clock and the write clock.

Figure 2:
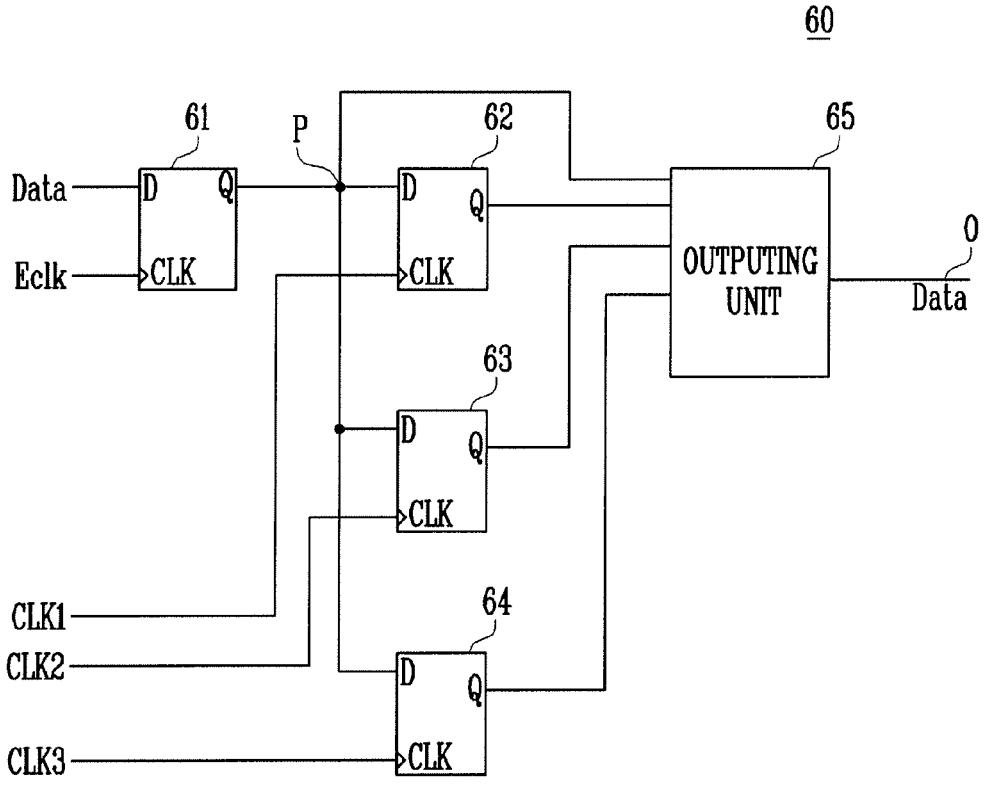
FIG. 2 illustrates an input controller of FIG. 1 according to an embodiment of the present invention.

FIG. 2 illustrates the input controller 60 of FIG. 1 according to an exemplary embodiment of the present invention. In FIG. 2, for the sake of convenience, three second storage units 62, 63, and 64 are illustrated. However, the present invention is not limited to the above. In practice, the at least one second storage unit is provided to control the output point of time of the data Data (i.e., point in time at which the data Data is output).

Referring to FIG. 2, the input controller 60 according to an exemplary embodiment includes a first storage unit 61 for receiving the data Data and the external clock Eclk from the outside, the second storage units 62, 63, and 64 for receiving the data Data from the first storage unit 61, and an outputting unit 65 for receiving the data Data from the second storage units 62, 63, and 64 and for controlling the output point of time of the received data Data.

The first storage unit 61 receives the data Data and the external clock Eclk from the outside. Here, the first storage unit 61 receives the data Data at the rising or falling edge of the external clock Eclk to store the data Data. For the sake of convenience of description, it is assumed that the data Data are stored at the rising point of time (the rising edge) of the external clock Eclk, however, the present invention is not limited thereto.

The second storage units 62, 63, and 64 receive the data Data output from the first storage unit 61. The second storage units 62, 63, and 64 also receive clock signals CLK1, CLK2, and CLK3 having different phases from the timing controller 50. That is, the first clock signal CLK1 is supplied to the first second storage unit 62 and the second clock signal CLK2 having a different phase from the phase of the first clock signal CLK1 is supplied to the second second storage unit 63. Then, a third clock signal CLK3 having a different phase from the phases of the first clock signal CLK1 and the second clock signal CLK2 is supplied to the third second storage unit 64.

Here, since the first to third clock signals CLK1 to CLK3 have the same periods, the rising edge (and/or the falling edge) of the clock signals CLK1, CLK2, and CLK3 are set to be different from each other. Therefore, the second storage units 62, 63, and 64 receive the data Data output from the first storage unit 61 at different points in time.

On the other hand, the first storage unit 61 and the second storage units 62, 63, and 64 are formed of a circuit element that can store the data Data when the clock signals are supplied, for example, a D flip-flop.

The outputting unit 65 sequentially compares the output data Data of the first storage unit 61 with the output data of the second storage units 62, 63, and 64 and outputs the data Data at the point in time where one of the output data of the second storage units 62, 63, and 64 is the same as the output data Data of the first storage unit 61. That is, the output data Data of the first storage unit 61 is compared with the output data of the first second storage unit 62 so that, when the two data are the same, the data Data are output and that, when the two data are not the same, the output data Data of the first storage unit 61 is compared with the output data of the second second storage unit 63. When the two data are the same, the data Data are output. When the two data are not the same, the output data Data of the first storage unit 61 is compared with the output data of the third second storage unit. When the two data are the same, the data Data are output.

Operation processes will be described in detail with reference to FIGS. 2 and 3. First, the data Data and the external clock Eclk are supplied from an external system to the first storage unit 61. At this time, the first storage unit 61 receives the data Data at the rising edge of the external clock Eclk to output the received data Data to a node P.

The first second storage unit 62 receives the data Data output at the node P when the first clock signal CLK1 is received to supply the received data Data to the outputting unit 65. Here, the first clock signal CLK1 is supplied from the timing controller 50 in order to control the output point in time of the data Data.

The outputting unit 65 sequentially compares the data Data of the node P with the data outputs from the first second storage unit 62, the second second storage unit 63 and the third second storage unit 64. Here, when the data Data at the node P is the same as the data output from the first second storage unit 62, the data Data output from the first second storage unit 62 is supplied to the timing controller 50. In practice, most of data Data supplied from the outputting unit 65 is determined by the output point in time of the data Data of the first second storage unit 62.

On the other hand, although the first clock signal CLK1 is supplied, the data Data at the node P may be different from the data Data of the first second storage unit 62, due to temperature, a use voltage and/or a process deviation.

According to an exemplary embodiment of the present invention, in order to solve the problem, the second second storage unit 63 and the third second storage unit 64 are additionally provided. In this case, the data Data of the node P is sequentially compared with the output data Data of the second second storage unit 63 and the third second storage unit 64.

Figure 3:
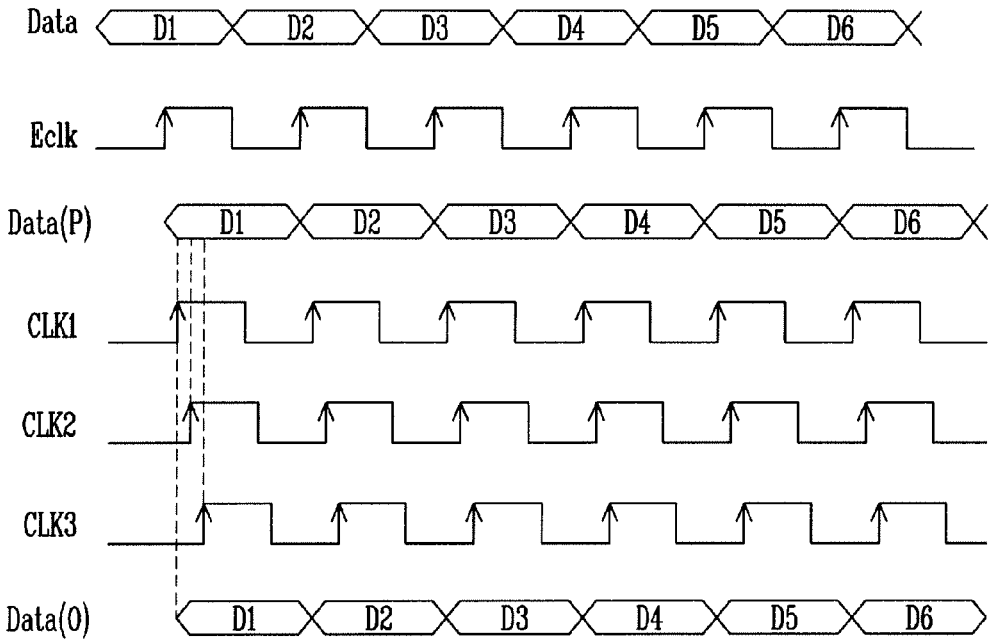
FIGS. 3 and 4 illustrate waveforms of the operation processes of the input controller of FIG. 2.
Figure 4:
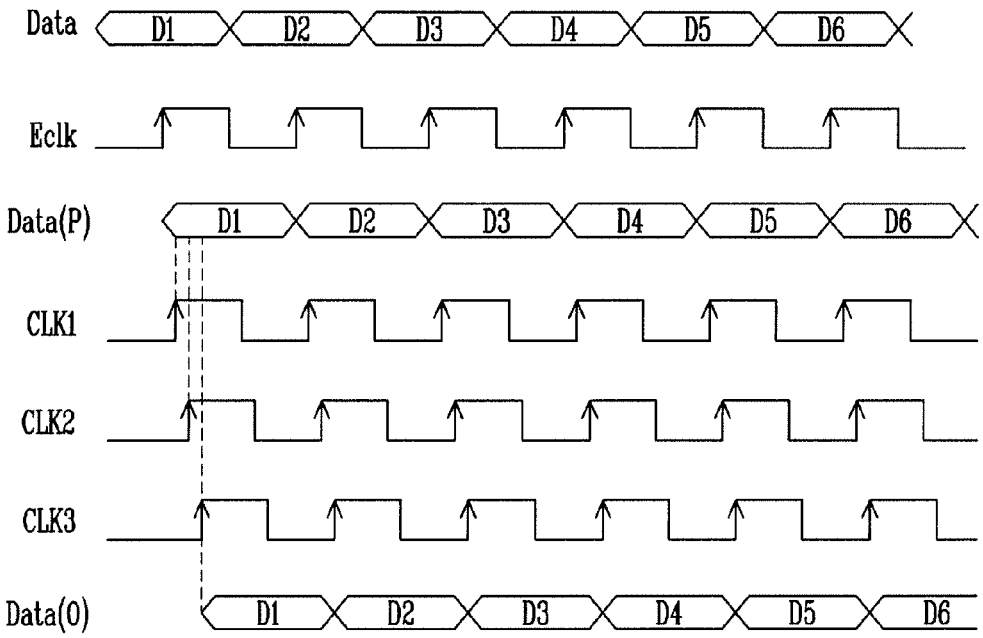

That is, most of data Data is supplied to the timing controller 50 at the point in time where the first clock signal CLK1 is supplied as illustrated in FIG. 3. However, partial data Data can be supplied to the timing controller 50 at the point in time where the third clock signal CLK3 is supplied as illustrated in FIG. 4. That is, according to the exemplary embodiment of the present invention, the second storage units 62, 63, and 64 are provided to secure the reliability of the operation.

Figure 5:
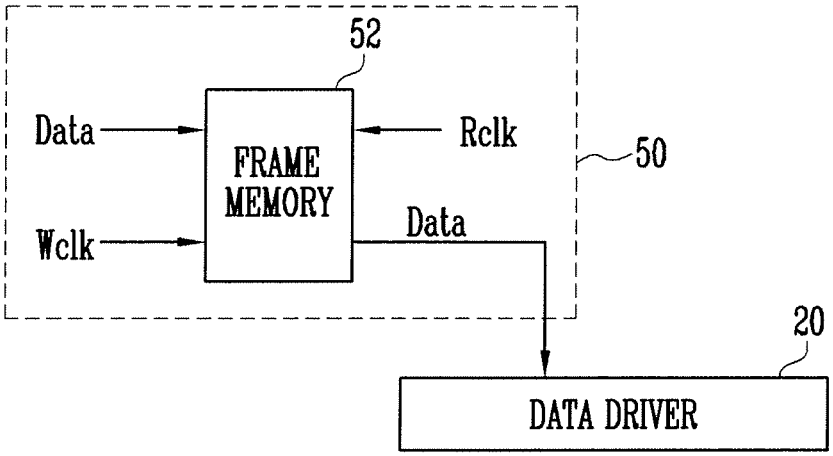
FIG. 5 illustrates a frame memory included in a timing controller.

FIG. 5 illustrates a frame memory included in a timing controller, for example, the timing controller 50 of FIG. 1.

Referring to FIG. 5, a frame memory 52 receives data Data from an input controller 60. The data Data supplied from the input controller 60 is stored in the frame memory 52 by a write clock Wclk generated by the timing controller 50. The data Data stored in the frame memory 52 is supplied to the data driver 20 by a read clock Rclk. Here, the read clock Rclk and the write clock Wclk are supplied so that the storage and output processes of the data are repeated in the frame memory 52. On the other hand, the write clock Wclk can be used as one of the clock signals CLK1, CLK2, CLK3, etc.

As described above, according to an exemplary embodiment of the present invention, since the supply point in time of the data Data from the input controller 60 to the timing controller 50 can be controlled by the clock signals CLK1, . . . of the timing controller 50, it is possible to prevent collision from being generated by the frame memory 52.

In the organic light emitting display according to an exemplary embodiment of the present invention and a method of driving the same, it is possible to control the supply point in time of the data using the input controller formed of the D flip-flop and to prevent the collision of the memory. In addition, since the input controller used according to an exemplary embodiment of the present invention is realized by a relatively simple circuit, a mounting area is reduced when an integrated circuit is realized.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

pixels positioned at crossings between scan lines and data lines;

a scan driver for driving the scan lines;

a data driver for driving the data lines;

a timing controller for controlling the scan driver and the data driver; and an input controller separate from the timing controller, the input controller for receiving data and an input clock, and for controlling a point in time where the data is supplied by the input controller to the timing controller in response to at least one clock signal supplied to the input controller from the timing controller.

2. The organic light emitting display as claimed in claim 1, wherein the input controller comprises:

a first storage unit for outputting first output data in response to the input clock;

at least one second storage unit for outputting second output data utilizing the first output data supplied from the first storage unit in response to the at least one clock signal; and an outputting unit for comparing the second output data of the at least one second storage unit with the first output data of the first storage unit to supply the data to the timing controller when the second output data of the second storage unit is the same as the first output data of the first storage unit.

3. The organic light emitting display as claimed in claim 2, wherein, when the at least one second storage unit comprises i second storage units, the timing controller supplies the at least one clock signal comprising i clock signals having different phases to the second storage units, wherein i is a natural number.

4. The organic light emitting display as claimed in claim 3, wherein the clock signals have a same period.

5. The organic light emitting display as claimed in claim 2, wherein the first storage unit and the second storage unit each comprise a D flip-flop.

6. The organic light emitting display as claimed in claim 1, wherein the timing controller comprises a frame memory to store the data.

7. The organic light emitting display as claimed in claim 6, wherein the frame memory is configured to store the data supplied from the input controller in response to a write clock and to supply the stored data to the data driver in response a read clock.

8. The organic light emitting display as claimed in claim 7, wherein the write clock comprises one of the at least one clock signal.

9. The organic light emitting display as claimed in claim 1, wherein the scan driver is configured to supply scan signals to the scan lines in each of a plurality of sub frames included in one frame, and wherein the data driver is configured to supply data signals to the data lines in synchronization with the scan signals.

10. A method of driving an organic light emitting display comprising a plurality of pixels, the method comprising:

supplying data from an external system to an input controller of the organic light emitting display;

controlling a point in time where the data is supplied from the input controller to a timing controller to be stored in a frame memory utilizing at least one clock signal supplied to the input controller by the timing controller of the organic light emitting display, the timing controller being separate from the input controller;

supplying data stored in the frame memory to a data driver to convert the data to a data signal; and controlling light emission of the plurality of pixels in accordance with the data signals.

11. The method as claimed in claim 10, wherein the timing controller comprises the frame memory.

12. The method as claimed in claim 10, wherein said controlling the point in time comprises:

storing the data in a first storage unit;

outputting the data from the first storage unit; and storing the data in a plurality of second storage units in response to the at least one clock signal comprising a plurality of clocks that have a same period and different phases.

13. The method as claimed in claim 12, wherein said controlling the point in time further comprises:

sequentially outputting the data from the plurality of second storage units and comparing the data output by the plurality of second storage units with the data output by the first storage unit, wherein the point in time is where the data output by one of the plurality of second storage units is the same as the data output by the first storage unit.

14. The method as claimed in claim 10, wherein the data signal is provided to a plurality of data lines in synchronization with a scan signal provided to a plurality of scan lines.

15. The method as claimed in claim 10, wherein said supplying the data stored in the frame memory comprises storing the data supplied from an input controller in response to a write clock and supplying the stored data to the data driver in response to a read clock.

* * * * *